United States Patent [19]

Allen et al.

[11] Patent Number: 4,577,993

[45] Date of Patent: Mar. 25, 1986

[54] POWER TROWEL WITH CAM-ACTUATED BLADE PITCH ADJUSTMENT MECHANISM

[75] Inventors: J. Dewayne Allen; Edward F. Randolph, both of Paragould, Ark.

[73] Assignee: Allen Engineering Corporation, Paragould, Ark.

[21] Appl. No.: 704,379

[22] Filed: Feb. 22, 1985

[51] Int. Cl.[4] ..... E01C 19/22

[52] U.S. Cl. ..... 404/112; 15/49 R; 51/177

[58] Field of Search ..... 404/112, 133; 15/49 R; 51/174, 177

[56] References Cited

U.S. PATENT DOCUMENTS

| | | | |
|---|---|---|---|
| 2,869,441 | 1/1959 | Barnes | 404/112 |
| 3,412,657 | 11/1968 | Colizza et al. | 404/112 |
| 3,458,885 | 8/1969 | Danielsson | 51/177 X |
| 3,791,754 | 2/1974 | Zochil | 404/112 |
| 4,198,178 | 4/1980 | Carlstrom | 404/112 |
| 4,232,980 | 11/1980 | Tertinek et al. | 404/112 |

OTHER PUBLICATIONS

Superior Featherweight Tools Co., Inc. Model GH Trowel Machine Brochure.

*Primary Examiner*—J. Howard Flint, Jr.
*Attorney, Agent, or Firm*—Cahill, Sutton & Thomas

[57] ABSTRACT

An engine-driven trowel includes a handle, a set of blades rotated within a single plane, a blade pitch control unit having a swash plate, a swash plate actuator arm and a pivot pin for pivotally coupling the actuator arm to the trowel. A blade pitch adjustment mechanism includes a lever-actuated cam assembly which engages and deflects the outboard end of the swash plate actuator arm. Up and down movements of the lever rotate the cam and displace the swash plate actuator arm to change the pitch of the trowel blades.

16 Claims, 6 Drawing Figures

POWER TROWEL WITH CAM-ACTUATED BLADE PITCH ADJUSTMENT MECHANISM

BACKGROUND OF THE INVENTION

1. Field of the Invention

This invention relates to power trowels, and more particularly, to engine driven power trowels having lever-actuated blade pitch adjustment mechanisms.

2. Description of the Prior Art

Various types of engine driven power trowels are currently available in the marketplace. Such trowels typically include a frame, an internal combustion engine coupled to the frame and three or four horizontally oriented, symmetrically disposed trowel blades. An upwardly extending trowel handle having a pair of handlebar grips enables an operator to control the movement of the trowel to complete finishing operations on partially cured concrete. Various blade pitch control mechanisms have been provided on such power trowel units to enable an operator to adjust the trowel blade pitch before or during finishing operations.

Superior Featherweight Tool Company of City of Industry, Calif., manufactures a Model GH power trowel which includes a lever-actuated blade pitch control unit. The lever arm adjustment mechanism is pivotally coupled to the trowel frame at a position close to the central axis of the trowel blades. Downward displacement of the outboard end of the lever arm results in upward displacement of the inboard end of the lever arm which is coupled to a swash plate. The resulting upward swash plate movement increases the blade pitch angle. This direct coupled, lever-actuated blade pitch adjustment mechanism permits an operator to rapidly change the pitch of the rotating trowel blades.

Another commercially available engine driven trowel of the type illustrated in FIGS. 1 and 2 provides a rotatable blade pitch adjustment wheel located between the handlebar grips of the trowel handle. Rotation of this handle in a clockwise or counterclockwise direction either gradually increases or gradually decreases the blade pitch. Rotation of that wheel actuates a threaded adjustment mechanism which is coupled within the trowel handle to a steel cable. The remote end of the steel cable is coupled to a swash plate actuator arm. To increase the blade pitch angle, the blade pitch adjustment wheel is rotated to actuate the threaded adjustment mechanism to retract the steel cable further into the trowel handle to thereby upwardly displace the outboard end of the swash plate actuator arm and downwardly displace the inboard end of the actuator arm. Swash plate displacements of this prior art power trowel produce blade pitch changes just the reverse of those produced by the Superior Featherweight power trowel discussed above, where an upward displacement of the swash plate increases blade pitch.

Certain power trowel users prefer the rapidly adjustable lever arm linkage of the type incorporated on the Superior Featherweight power trowel, while other users prefer the slower but more precisely adjustable blade adjustment mechanism of the type incorporated in the trowel depicted in FIGS. 1 and 2.

SUMMARY OF THE INVENTION

It is therefore a primary object of the present invention to provide a power trowel having a wheel actuated blade pitch adjustment mechanism which can readily be modified to incorporate a lever-actuated blade pitch adjusment mechanism.

Another object of the present invention is to provide a power trowel having a lever-actuated, cam operated swash plate displacement device wherein downward displacement of the lever arm results in increasing blade pitch.

Another object of the present invention is to provide a power trowel having a lever-actuated blade pitch adjustment mechanism incorporating a cam having a camming surface extending along the interior of a semicircular aperture in the cam.

Briefly stated, and in accord with one embodiment of the invention, an engine driven power trowel includes a frame, a handle and a blade pitch control unit. The blade pitch control unit includes a swash plate and a swash plate actuator arm having an inboard end engaging the swash plate, a pivot pin for pivotally coupling the actuator arm to the trowel and an outboard end. Swash plate actuator arm displacement means includes a support bracket. The support bracket is coupled to the trowel in proximity to the swash plate actuator arm. A fixed stud extends laterally outward from the support bracket. A moveable stud is oriented parallel to the fixed stud and extends laterally outward from the outboard end of the actuator arm. The cam is rotatably coupled to the fixed stud and includes a camming surface for engaging the moveable stud. Cam rotating means deflects the cam in first and second directions about the fixed stud to cause the camming surface to alternately displace the swash plate actuator arm in first and second directions. In response to these cam deflections, the trowel blade pitch is alternately increased or decreased.

DESCRIPTION OF THE DRAWINGS

The invention is pointed out with particularity in the appended claims. However, other objects and advantages together with the operation of the invention may be better understood by reference to the following detailed description taken in connection with the following illustrations, wherein:

DESCRIPTION OF THE PREFERRED EMBODIMENT

In order to better illustrate the advantages of the invention and its contributions to the art, a preferred hardware embodiment of the invention will now be described in detail.

Figure 1:
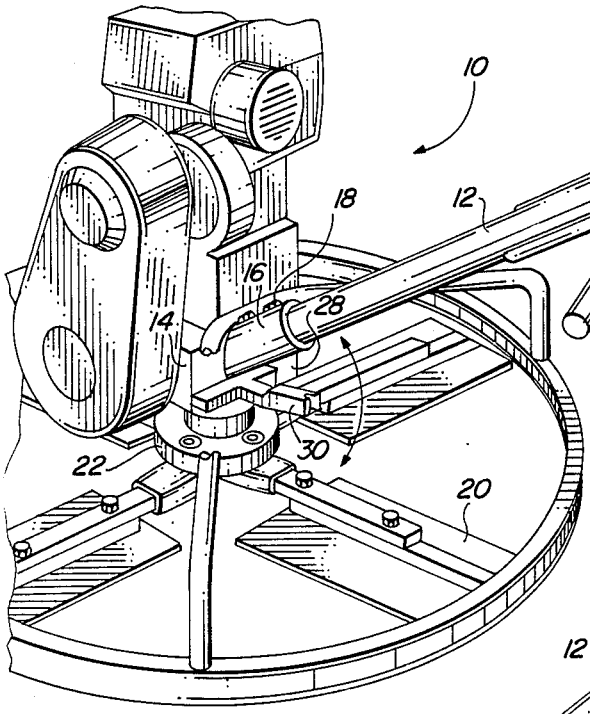
FIG. 1 (PRIOR ART)
FIG. 1 illustrates a commercially available power trowel having a wheel-actuated blade pitch adjustment mechanism.
Figure 2:
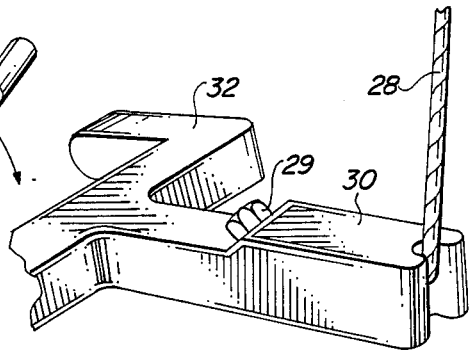
FIG. 2 (PRIOR ART)
FIG. 2 is a partially cutaway, enlarged perspective view of the swash plate actuator arm of the power trowel illustrated in FIG. 1.

FIGS. 1 and 2 illustrate a commercially available, engine-driven power trowel 10 including a wheel-actuated blade pitch adjustment mechanism. Trowel 10 includes an upwardly inclined trowel handle 12, having a lower end coupled to the trowel frame 14. The hollow cylindrical handle 12 is dimensioned to fit within a handle retaining bracket 16. A pair of parallel oriented bolts 18 extend through handle 12 and bracket 16 to securely couple handle 12 to frame 14. Trowel 10 includes a set of three or four symmetrically spaced apart blades 20 which are coupled to a centrally located hub 22. A blade pitch control wheel 24 is rotatably coupled to the upper end of trowel handle 12 between handlebar grips 26. The trowel is controlled and guided by an operator who grasps handlebars 26. Control wheel 24 actuates a threaded adjustment mechahism which is located inside handle 12. The upper end of a steel cable 28 is coupled to the length adjustment mechanism while the opposite end of cable 28 is coupled by bolt 29 to swash plate actuator arm 30 which includes a pair of spaced apart forks 32.

The operator of the prior art engine driven trowel depicted in FIGS. 1 and 2 controls blade pitch by rotating wheel 24 in a clockwise or counterclockwise direction to actuate the threaded adjustment mechanism to displace swash plate actuator arm 30. Several rotations of the threaded adjustment mechanism control wheel 24 are required to reconfigure the trowel blades between high and low pitch angles. The time required to accomplish such blade pitch changes substantially exceeds that required to produce equivalent changes with the Superior Featherweight power trowel.

The cam-actuated blade pitch adjustment mechanism illustrated in FIGS. 3–6 can be easily retrofitted to the power trowel depicted in FIG. 1 to permit that device to achieve the advantages of the lever-actuated blade pitch adjustment mechanism.

Figure 3:
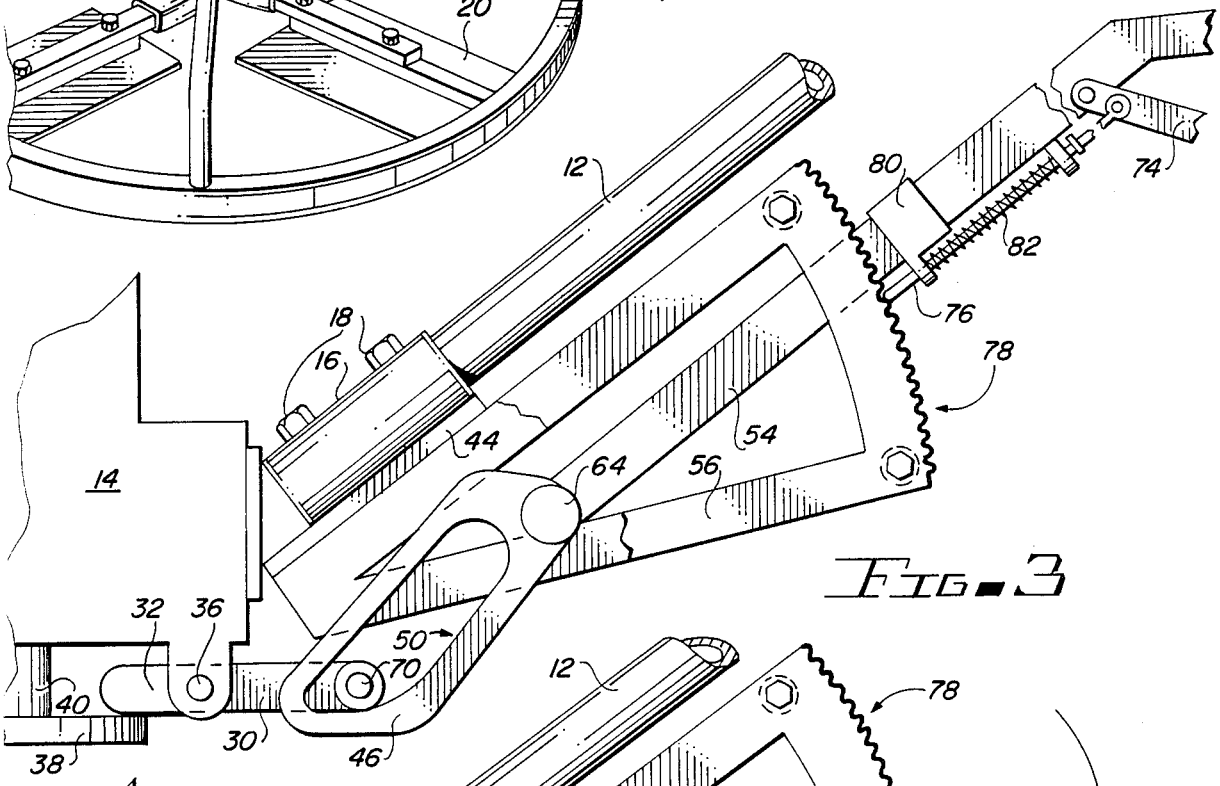
FIG. 3 is a partially cutaway elevational view of the present invention illustrating the swash plate actuator arm displacement unit in a comparatively low blade pitch configuration.

As illustrated in FIG. 3, actuator arm 30 is pivotally coupled to trowel frame 14 by a pivot pin 36. Forks 32 contact the upper surface of a swash plate 38 and control the relative vertical position of swash plate 38 with respect to trowel blade drive shaft 40. FIG. 3 depicts swash plate 38 in an equilibrium position where low or zero displacement forces are present between swash plate 38 and actuator arm 30, resulting in a zero blade pitch angle.

Referring now to FIGS. 3–6, swash plate actuator arm displacing means for converting a wheel-actuated blade pitch adjustment mechanism to a lever-actuated mechanism will now be described in detail. A support bracket 44 is rigidly secured to the lower surface of the handle retaining bracket 16 by existing bolts 18. A cam 46 includes a semi-circular aperture 48 which defines a camming surface 50. A coupling 52 having a cylindrical aperture is coupled to the upper end section of cam 46. A cam actuation lever 54 is also coupled to the upper end section of cam 46 to rotationally displace cam 46. A pair of spaced apart brackets 56 are coupled by bolts 58 to a mounting block 60 which forms a part of the vertically oriented face of support bracket 44. A plurality of spacers 62 maintain a fixed spacing between brackets 56. A fixed stud 64 passes through an aperture in coupling 52 to rotatably couple the cam 46/lever arm 54 assembly to support bracket 44.

A threaded aperture 66 is drilled into the vertically oriented face of the outboard end of swash plate actuator arm 30 to receive the threaded end of a moveable stud 68. A roller unit 70 is rotatably coupled to the outboard end of stud 68. An optional spacer 72 may be positioned as shown between the inner surface of roller unit 70 and the inner vertical face of actuator arm 30.

The present invention also includes a cam locking means which holds the cam actuation lever 54 in a predetermined position determined by the operator. This structure includes a trigger actuated hand grip 74 which includes spring biased linkage 76, the end of which forms a pawl for engaging the ratchet-like, curved edge 78 of frame members 56. A handle-mounted bracket 80 includes a cylindrical aperture for maintaining the end of linkage 76 in a fixed position and for retaining the biasing spring 82 in position.

FIG. 3 depicts cam actuation lever 54 in a comparatively elevated position where moveable stud 68 and its roller unit 70 engage the left edge of camming surface 50. In this configuration, very little if any pressure is exerted between forks 32 of actuator arm 30 and the upper surface of swash plate 38, resulting in a zero blade pitch angle.

Figure 4:
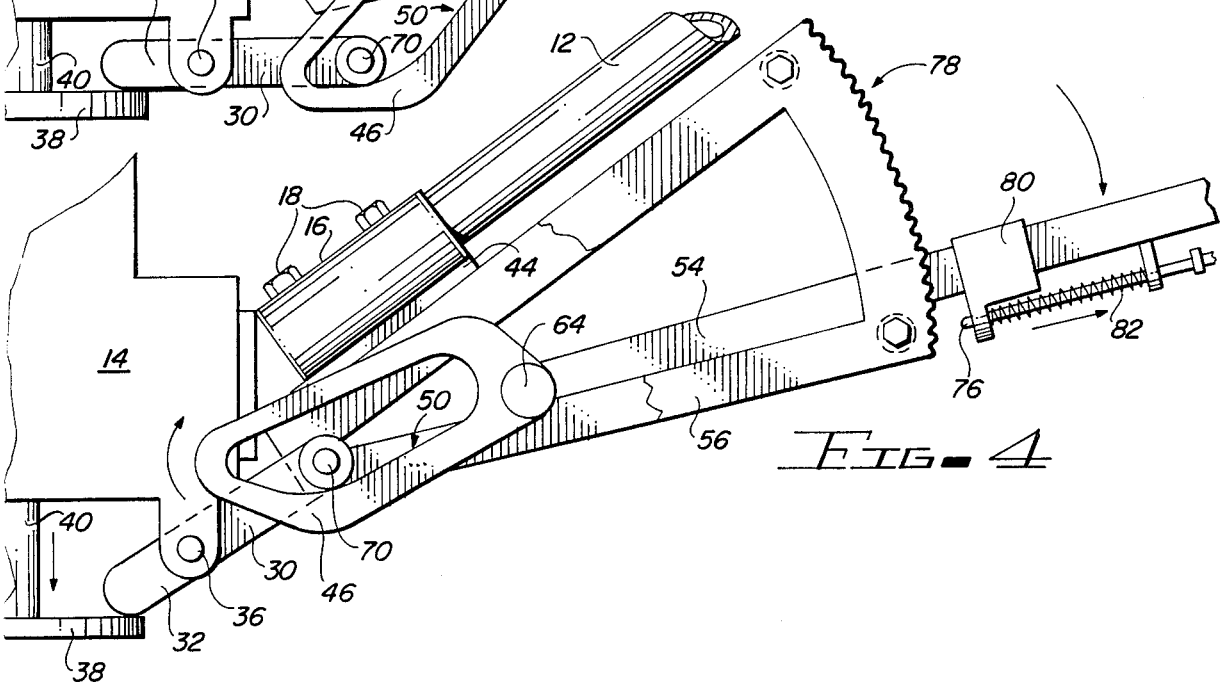
FIG. 4 is a partially cutaway elevational view of the present invention illustrating the swash plate actuator arm displacement unit in a comparatively high blade pitch configuration.
Figure 5:
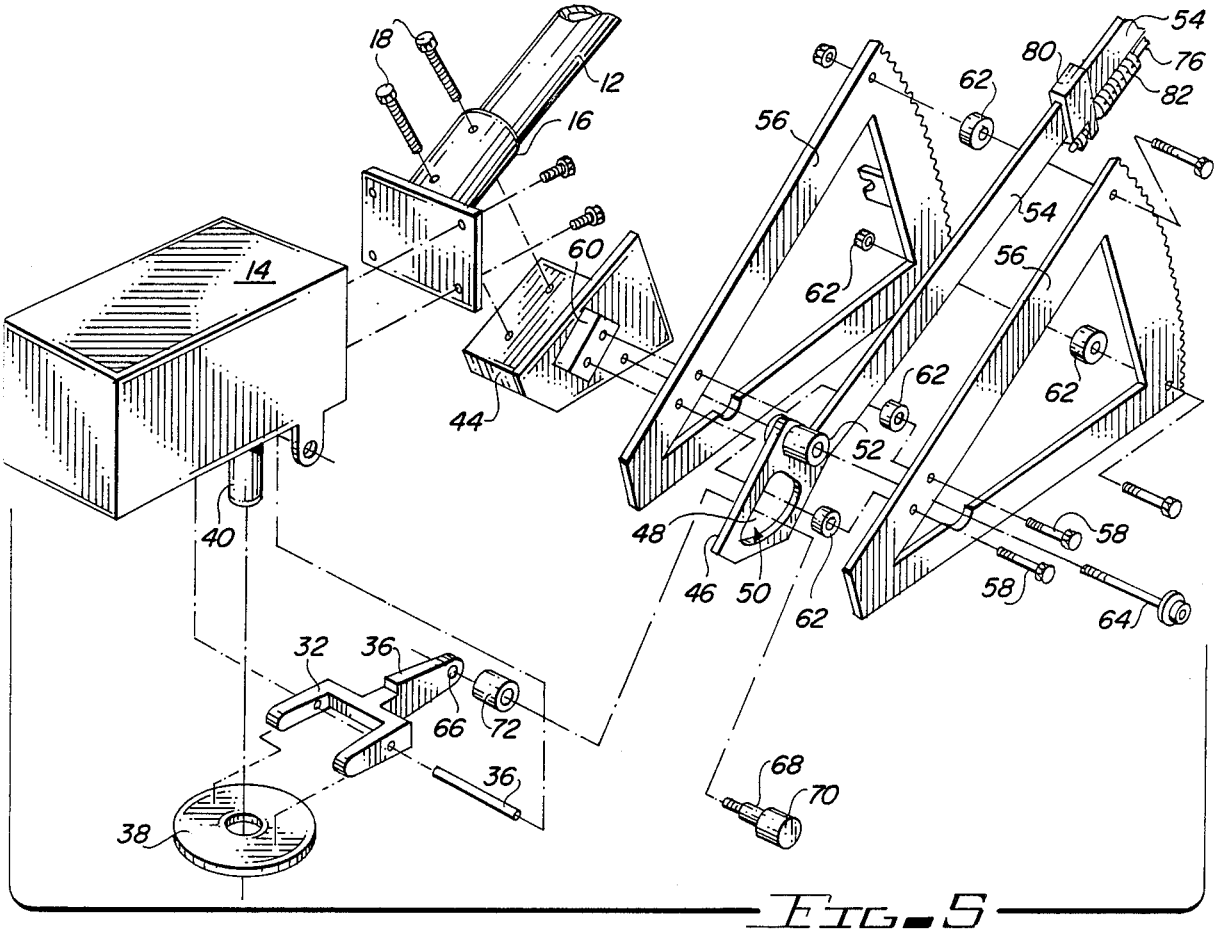
FIG. 5 represents an exploded perspective view of the specific structural elements used to fabricate the preferred embodiment of the present invention.
Figure 6:
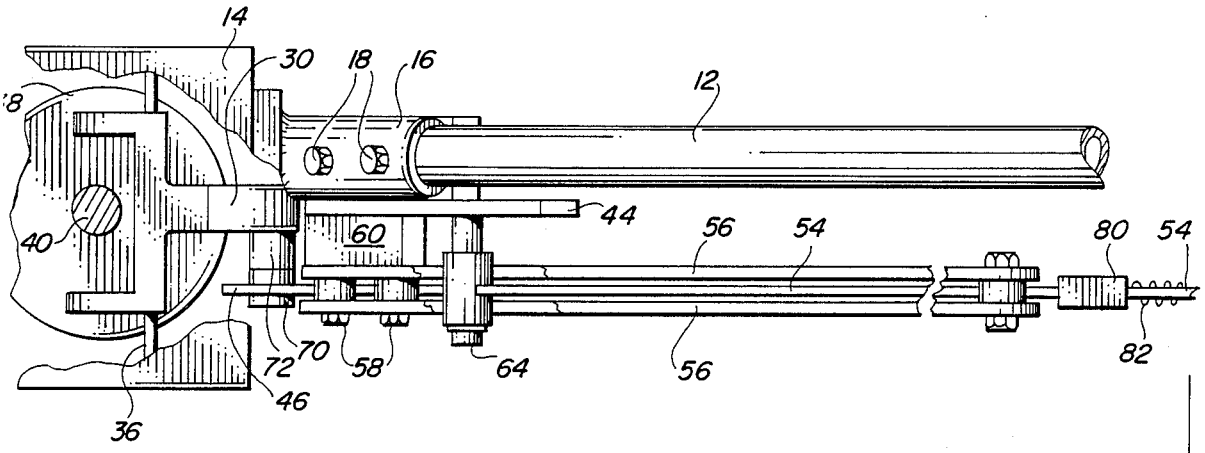
FIG. 6 is a partially cutaway view from above of the cam-actuated blade pitch adjustment mechanism of the present invention.

As indicated by FIG. 4, a downward displacement of cam actuation lever 54 rotates cam 46 in a clockwise direction causing roller unit 70 of moveable stud 68 to traverse to the right and upward along camming surface 50. Such rotational displacement of cam 46 lifts or elevates moveable stud 68 and the outboard end of actuator arm 30 causing downward displacement of the inboard forks 32 of actuator arm 30. The downward pressure exerted on swash plate 38 by the two spaced apart forks 22 displaces swash plate 38 downward along shaft 40 into the position illustrated in FIG. 4 and increases the blade pitch angle. When the desired blade pitch angle has been achieved, the operator releases hand grips 74 and engages pawl 76 with the ratchet face 78 of brackets 56.

The unique structure of the present invention incorporating a cam including an aperture defining a camming surface within the perimeter of the cam in combination with fixed and moveable studs coupled to existing structure on a commercially available power trowel converts a wheel-actuated blade pitch adjustment mechanism to a lever actuated mechanism. The resulting blade pitch adjustment mechanism is capable of duplicating the rate of blade pitch change per unit of lever displacement of existing lever actuated power trowels. Alternatively, various different blade pitch adjustment rates may be provided by reconfiguring camming surface 50 while still providing the customary increasing blade pitch angles in response to downward displacements of lever arm 54. In addition, the removal of bolts 18 permits the entire lever-actuated blade pitch control mechanism of the present invention to be detached from the trowel so that the original FIG. 1 wheel-actuated blade pitch adjustment mechanism can be reconnected.

It will be apparent to those skilled in the art that the disclosed cam-actuated blade pitch adjustment mechanism for a power trowel can be modified in numerous ways and may assume many embodiments other than the preferred form specifically set out and described above. For example, the shape of cam 46 and the contour of camming surface 50 could be readily modified to provide different rates of change in pitch angle for a given angular displacement of lever arm 54. In addition, numerous other different types of lever arm locking means other than the specific ratchet/pawl assembly depicted would be readily apparent to one of ordinary skill in the art. Accordingly, it is intended by the appended claims to cover all such modifications of the invention which fall within the true spirit and scope of the invention.

I claim:

1. A power trowel having a cam-actuated blade pitch adjustment mechanism, comprising:

a. a trowel frame;

b. an engine coupled to said frame and including an output shaft;

c. a set of blades rotated within a fixed plane by the output shaft of said engine;

d. a blade pitch control unit for controlling the pitch of said blades;

e. a handle having a first end coupled to said trowel frame and a second end laterally spaced apart from said trowel and elevated above the plane of said blades;

f. said blade pitch control unit including i. a swash plate;

ii. a swash plate actuator arm having an inboard end engaging said swash plate and an outboard end;

iii a pivot pin for pivotally coupling said actuator arm to said trowel;

g. means for displacing the outboard end of said swash plate actuator arm, including i. a support bracket coupled to said trowel frame in proximity to said actuator arm;

ii. a fixed stud secured to and extending laterally outward from said bracket;

iii. a moveable stud extending laterally outward from the outboard end of said actuator arm;

iv. a cam rotatably coupled to said fixed stud and including a camming surface engaging said moveable stud; and v. means for rotating said cam in first and second directions about said fixed stud to cause said camming surface to alternately displace said moveable stud and said actuator arm in first and second directions to thereby alternately increase or decrease the pitch of said trowel blades.

2. The apparatus of claim 1 wherein said cam comprises a member having an aperture defining a contoured surface for receiving and engaging said moveable stud and wherein said contoured surface forms the camming surface of said cam.

3. The apparatus of claim 2 wherein the contour of said camming surface determines the magnitude of displacement of said swash plate actuator arm in response to predetermined displacements of said cam rotating means.

4. The apparatus of claim 3 wherein said aperture includes a semi-circular aperture.

5. The apparatus of claim 4 wherein said moveable stud is oriented parallel to said fixed stud.

6. The apparatus of claim 5 wherein said cam includes a plate oriented perpendicular to the axes of said fixed and moveable studs.

7. The apparatus of claim 2 wherein said cam includes first and second end sections and wherein said cam rotating means includes a cam actuation lever arm coupled to the second end of said cam.

8. The apparatus of claim 7 wherein said cam rotating means further includes means for locking said cam in a predetermined rotational position to thereby maintain a fixed blade pitch.

9. The apparatus of claim 8 wherein said cam locking means includes a cam actuation lever guide frame coupled to said support bracket and means for securing said cam actuator lever arm to said lever guide frame at selected positions.

10. The apparatus of claim 9 wherein said lever arm securing means includes a ratchet/pawl locking unit.

11. The apparatus of claim 1 wherein said support bracket, said fixed stud, said cam and said cam rotating means comprise a unitary assembly and wherein said apparatus further includes means for rapidly connecting said unitary assembly to said trowel frame.

12. The apparatus of claim 2 wherein said cam rotating means includes a cam actuation lever arm coupled to said cam and wherein the camming surface of said cam is configured such that a downward displacement of said lever arm actuates said blade pitch control unit to increase the blade pitch and an upward displacement of said lever arm actuates said blade pitch control unit to decrease the blade pitch.

13. The apparatus of claim 12 wherein:

a. said support bracket includes a vertical face extending below said handle; and b. said fixed stud is coupled to the vertical face of said bracket.

14. The apparatus of claim 13 wherein said fixed and moveable studs are horizontally oriented and wherein said moveable stud extends through the aperture in said member and engages the contoured camming surface of said cam.

15. The apparatus of claim 14 wherein said moveable stud includes a roller unit rotatably coupled to said moveable stud for substantially reducing the frictional force between said moveable stud and said camming surface.

16. The apparatus of claim 11 wherein said connecting means includes first and second spaced apart bolts extending through said trowel handle and said support bracket.

* * * * *